US011059156B2

(12) United States Patent
Abe et al.

(10) Patent No.: US 11,059,156 B2
(45) Date of Patent: Jul. 13, 2021

(54) IMPACT TOOL

(71) Applicant: HITACHI KOKI CO., LTD., Tokyo (JP)

(72) Inventors: Satoshi Abe, Ibaraki (JP); Takahiro Ookubo, Ibaraki (JP); Hideyuki Hashimoto, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 206 days.

(21) Appl. No.: 15/546,967

(22) PCT Filed: Jan. 8, 2016

(86) PCT No.: PCT/JP2016/050498
§ 371 (c)(1),
(2) Date: Jul. 27, 2017

(87) PCT Pub. No.: WO2016/121458
PCT Pub. Date: Aug. 4, 2016

(65) Prior Publication Data

US 2018/0021931 A1 Jan. 25, 2018

(30) Foreign Application Priority Data

Jan. 28, 2015 (JP) ..... JP2015-014473

(51) Int. Cl.
*B25D 16/00* (2006.01)
*B25D 17/24* (2006.01)

(52) U.S. Cl.
CPC ..... *B25D 16/006* (2013.01); *B25D 17/24* (2013.01); *B25D 2216/0015* (2013.01);
(Continued)

(58) Field of Classification Search
CPC ..... B25D 16/006; B25D 17/24; B25D 2216/0015; B25D 2216/0023;
(Continued)

(56) References Cited

U.S. PATENT DOCUMENTS 6,607,041 B2 * 8/2003 Suzuki ..... B25B 21/02 173/11
6,681,869 B2 * 1/2004 Wursch ..... B23B 49/006 173/11
(Continued)

FOREIGN PATENT DOCUMENTS

EP 1 695 795 A1 8/2006
JP 2001-062756 A 3/2001
(Continued)

OTHER PUBLICATIONS

European Office Action issued in corresponding European Patent Application No. 16743062.8-1017, dated Jun. 18, 2020.
(Continued)

*Primary Examiner* — Thomas M Wittenschlaeger
*Assistant Examiner* — Scott A Howell
(74) *Attorney, Agent, or Firm* — McDermott Will & Emery LLP

(57) ABSTRACT

An impact tool that realizes an ON-lock function with a simple mechanism and makes it possible to switch between activation and deactivation of the ON-lock function with few operation processes is provided. A hammer drill having at least two operating modes including a hammer mode in which an impact force is transmitted to a tool bit whereas a rotational force is not transmitted thereto includes: a motor as a power source; a trigger lever and an ON-lock button that are operated by an operator; a sensor that detects whether a selected operating mode is the hammer mode or not; and a controller that controls the motor based on an operation of
(Continued)

the trigger lever and the ON-lock button. When the ON-lock button is operated while the hammer mode is selected, the controller performs ON-lock control to maintain the motor in the operating state even when the trigger lever is not operated.

12 Claims, 5 Drawing Sheets

(52) U.S. Cl.
CPC ..... *B25D 2216/0023* (2013.01); *B25D 2216/0084* (2013.01); *B25D 2222/72* (2013.01); *B25D 2250/121* (2013.01); *B25D 2250/221* (2013.01); *B25D 2250/261* (2013.01); *B25D 2250/265* (2013.01)

(58) Field of Classification Search
CPC ..... B25D 2216/0084; B25D 2222/72; B25D 2250/72; B25D 2250/121; B25D 2250/221; B25D 2250/261; B25D 2250/265
USPC ..... 173/11
See application file for complete search history.

(56) References Cited

U.S. PATENT DOCUMENTS 6,799,643 B2 * 10/2004 Voulkidis ..... B25D 11/00 173/11
6,843,327 B2 * 1/2005 Meixner ..... B25D 11/125 173/10
7,398,834 B2 * 7/2008 Jung ..... B25D 16/006 173/11
7,681,659 B2 * 3/2010 Zhang ..... B23D 59/001 173/1
8,251,158 B2 * 8/2012 Tomayko ..... B23B 45/008 173/11
8,286,724 B2 * 10/2012 Furusawa ..... B25D 11/10 173/47
8,505,647 B2 * 8/2013 Kasuya ..... B25D 11/005 173/11
8,698,430 B2 * 4/2014 Watanabe ..... B25F 5/001 173/11
2002/0046847 A1 4/2002 Ichijyou et al.
2003/0121678 A1 7/2003 Manschitz et al.
2005/0103510 A1 * 5/2005 Gass ..... B23B 31/123 173/217
2006/0185866 A1 * 8/2006 Jung ..... B25D 16/006 173/48
2008/0017396 A1 1/2008 Kristen et al.
2010/0236800 A1 9/2010 Watanabe et al.
2014/0000921 A1 * 1/2014 Vanko ..... G01C 9/00 173/11
2015/0000943 A1 * 1/2015 Diem ..... B25D 16/00 173/11
2015/0231778 A1 * 8/2015 Borst ..... B25F 5/02 173/1

FOREIGN PATENT DOCUMENTS

JP 2004-330379 A 11/2004
JP 2008-272880 A 11/2008
JP 1281273 B2 6/2009
JP 2010-221328 A 10/2010

OTHER PUBLICATIONS

Chinese Office Action issued in corresponding Chinese Application No. 201680007129.2, dated Mar. 3, 2020, with English translation.
International Search Report issued in Application No. PCT/JP2016/050498 dated Mar. 29, 2016, with English translation.

* cited by examiner

IMPACT TOOL

RELATED APPLICATIONS

This application is the U.S. National Phase under 35 U.S.C. § 371 of International Application No. PCT/JP2016/050498, filed on Jan. 8, 2016, which in turn claims the benefit of Japanese Application No. 2015-014473, filed on Jan. 28, 2015, the disclosures of which are incorporated by reference herein.

TECHNICAL FIELD

The present invention relates to an impact tool that applies a rotational force or an impact force to a tool bit to drill a hole in an object or crush an object with the tool bit.

BACKGROUND ART

An impact tool that applies a rotational force or an impact force to a tool bit such as a drill bit to drill a hole in a concrete wall, a concrete floor or the like or crush it with the drill bit has been known, and such an impact tool is generally referred to as a "hammer drill".

Most of conventional hammer drills have at least two operating modes. A conventional hammer drill has, for example, a hammer mode in which only an impact force is transmitted to a drill bit, and a hammer drill mode in which both of an impact force and a rotational force are transmitted to the drill bit. In the conventional hammer drill having a plurality of operating modes, when a trigger lever is operated by an operator, required power is transmitted to the drill bit in accordance with a selected operating mode.

Here, the hammer mode is mainly selected for crushing work, and the hammer drill mode is mainly selected for drilling work. In general, the crushing work does not reed to be delicate, but is continuously performed over a long time as compared with the drilling work.

RELATED ART DOCUMENTS

Patent Documents

Patent Document 1: Japanese Patent No. 4281273

SUMMARY OF THE INVENTION

Problems to be Solved by the Invention

When the hammer mode is selected in the work using the impact tool, it is preferable that the work can be continued even when an operator releases a trigger lever, namely, a motor is maintained in an operating state even when the trigger lever is not pulled. On the other hand, when the hammer drill mode is selected, the motor is preferably switched between the operating state and a stop state in accordance with the operation of the trigger lever in order to adjust a size and depth of a hole.

Accordingly, it has been desired to provide a hammer drill having a function of maintaining the motor in the operating state even if the trigger lever is not operated when the hammer mode is selected. Such a function is referred to as an ON-lock function as needed in the present specification.

An object of the present invention is to achieve the ON-lock function with a simple mechanism and to make it possible to switch between activation and deactivation of the ON-lock function with few operation processes.

Means for Solving the Problems

In an aspect of the present invention, an impact tool has at least two operating codes including a first operating mode in which an impact force is transmitted to a tool bit whereas a rotational force is not transmitted to the tool bit. The impact tool includes: a motor as a power source; a first, operation part and a second operation part operated by an operator; a mode detection part detecting whether a selected operating mode is the first operating mode or not; and a control part controlling the motor based on an operation of the first operation part and the second operation part. When the second operation part is operated while the first operating mode is selected, the control part performs ON-lock control to maintain the motor in an operating state even when the first operation part is not operated.

In another aspect of the present invention, an impact tool has a first operating mode in which an impact force is transmitted to a tool bit whereas a rotational force is not transmitted to the tool bit and a second operating mode in which at least the rotational force is transmitted to the tool bit. The impact tool includes: a motor as a power source; a first operation part and a second operation part operated by an operator; and a control part controlling ON/OFF of the motor based on an operation of the first operation part and the second operation part. When the first operating mode is selected, the control part controls ON/OFF of the motor based on the operation of the first operation part and the operation of the second operation part, and performs ON-lock control to maintain the motor in an ON state by the operation of the second operation part. In addition, when the second operating mode is selected, the control part controls ON/OFF of the motor based on the operation of the first operation part.

In another aspect of the present invention, the control part stops the motor when the first operation part is operated while the ON-lock control is performed.

In another aspect of the present invention, the control part stops the motor when the first operation part is operated while the ON-lock control is performed, and then the operation of the first operation part is released.

In another aspect of the present invention, when the first operation part is operated while the ON-lock control is performed, the control part stops performing the ON-lock control and controls the motor based on the operation of the first operation part.

In another aspect of the present invention, the second operation part is a tactile switch outputting a signal to the control part for each operation.

In another aspect of the present invention, the impact tool further includes a lighting part, and the control part lights the lighting part while the ON-lock control is performed.

Effects of the Invention

According to the present invention, it is possible to realize the impact tool that achieves the ON-lock function with the simple mechanism and makes it possible, to switch between activation and deactivation of the ON-lock function with few operation processes.

BRIEF DESCRIPTIONS OF THE DRAWINGS

DETAILED DESCRIPTION OF PREFERRED EMBODIMENTS

Hereinafter, a first embodiment of an impact tool according to the present invention will be described. The impact tool according to the present embodiment is a hammer drill capable of attaching and detaching a drill bit as an example of a tool bit. Although applications of the hammer drill according to the present embodiment are not particularly limited, the hammer drill is suitable for the work for drilling a hole in an object such as a concrete wall or a stone material or for crushing the object. In addition, the hammer drill according to the present embodiment has a first operating mode in which an impact force is transmitted to the drill bit whereas a rotational force is not transmitted thereto, and a second operating mode in which at least the rotational force is transmitted to the drill bit. Further, in the second operating mode in this embodiment, the impact force is transmitted to the drill bit in addition to the rotational force. Accordingly, in the following description, the first operating mode is referred to as a "hammer mode", and the second operating mode is referred to as a "hammer drill mode".

Figure 1:
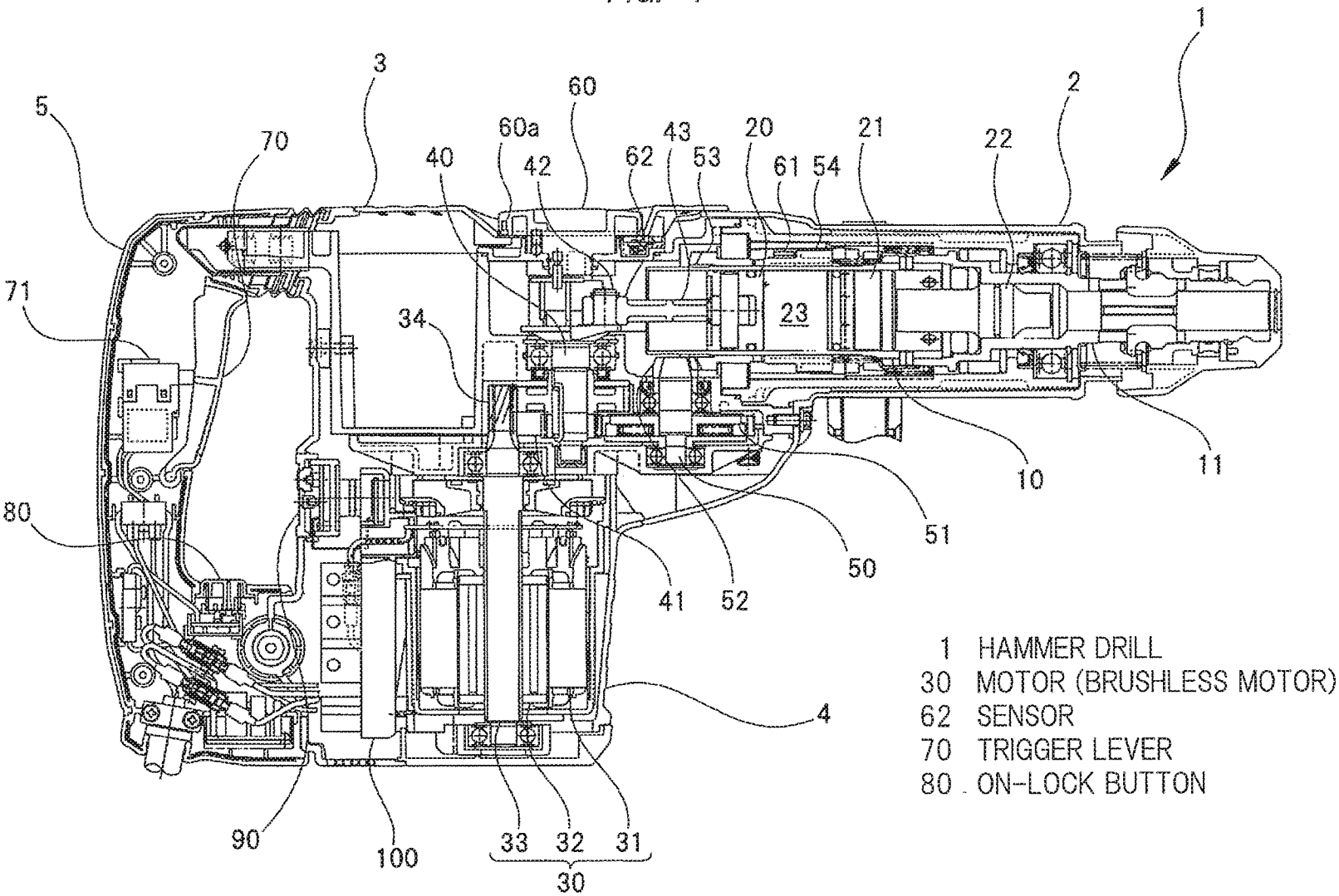
FIG. 1 is a cross-sectional view showing a structure of a hammer drill.

As shown in FIG. 1, the hammer drill 1 includes a cylinder housing 2, an intermediate housing 3, a motor housing 4, and a handle 5, and these are fixed to and integrated with each other. The cylinder housing 2 is cylindrical as a whole, and the intermediate housing 3 and the motor housing 4 are arranged between a first longitudinal end (rear end) of the cylinder housing 2 and the handle 5. The intermediate housing 3 and the motor housing 4 are vertically overlapped, and one end (lower end) of the handle 5 is coupled to the motor housing 4, and the other end (upper end) of the handle 5 is coupled to the intermediate housing 3. The handle 5 is coupled to the intermediate housing 3 and the motor housing 4 with a vibration-isolation mechanism interposed therebetween.

Inside the cylinder housing 2, a cylinder 10 in a cylindrical shape and a retainer sleeve 11 are housed. The cylinder 10 and the retainer sleeve 11 are concentric, and a part of the retainer sleeve 11 protrudes from a tip of the cylinder housing 2. The cylinder 10 and the retainer sleeve 11 are engaged so as to be relatively unrotatable, and the cylinder 10 and the retainer sleeve 11 integrally rotate about a center axis as a rotation axis when a rotational force is transmitted to the cylinder 10. In addition, a part of the drill bit (not shown) is inserted into the retainer sleeve 11. The drill bit inserted into the retainer sleeve 11 is engaged with the retainer sleeve 11 so as toy be unmovable in a rotational direction and movable within a predetermined range in an axial direction. Consequently, when the cylinder 10 and the retainer sleeve 11 rotate, a rotational force is transmitted to the drill bit, and the drill bit is rotated. Further, when an impact force is transmitted to the drill bit, the drill bit is reciprocally moved within a predetermined range in the axial direction. Movement of the cylinder 10, the retainer sleeve 11, and the drill bit will be described in detail later.

Inside the cylinder 10, a piston 20 and an impact element 21 are housed in a reciprocally movable manner. In addition, an intermediate element 22 is housed in a reciprocally movable manner so as to be laid across the cylinder 10 and the retainer sleeve 11. The piston 20, the impact element 21, and the intermediate element 22 are aligned in this order from a rear side to a front side of the cylinder 10. Further, an air chamber 23 is provided between the piston 20 and the impact element 21 inside the cylinder 10.

A motor 30 as a power source is housed in the motor housing 4. The motor 30 is an inner rotor brushless motor, and has a stator 31 in a cylindrical shape, a rotor 32 disposed inside the stator 31, and an output shaft 33 disposed inside the rotor 32. The output shaft 33 is fixed to the rotor 32, and vertically extends to pass through the rotor 32. A center axis of the output shaft 33 is orthogonal to a center axis of the cylinder 10 and the retainer sleeve 11.

An upper part of the output shaft 33 protruding from the rotor 32 passes through a partition between the motor housing 4 and the intermediate housing 3, to enter inside the intermediate housing 3. A pinion gear 34 is provided at an upper end of the output shaft 33 protruding inside the intermediate housing 3. Inside the intermediate housing 3, a first driving shaft 40 is rotatably disposed near the output shaft 33, and a second driving shaft 50 is rotatably disposed near the first driving shaft 40. The output shaft 33, the first driving shaft 40, and the second driving shaft 50 are in parallel with each other.

A first gear 41 that is meshed with the pinion gear 34 is provided at a lower part of the first driving shaft 40, an eccentric pin 42 is provided at an upper part of the first driving shaft 40, and this eccentric pin 42 is coupled to the piston 20 via a connecting rod 43.

A second gear 51 that is meshed with the first gear 41 is provided at a lower part of the second driving shaft 50, a bevel gear 52 is provided at an upper part of the second driving shaft 50, and this bevel gear 52 is meshed with a ring gear 53 disposed around the cylinder. The ring gear 53 is mounted on an outer circumferential surface of the cylinder 10 via a sliding bearing (metal), and freely rotates with respect to the cylinder 10.

A sleeve 54 is provided on the outer circumferential surface of the cylinder 10 in addition to the ring gear 53. The sleeve 54 integrally rotates with the cylinder 10, and individually slides reciprocally in an axial direction of the cylinder 10. A spring always applies a force to the sleeve 54 in a direction approaching to the ring gear 53.

A mode-switching dial 60 is provided on a top surface of the intermediate housing 3. The hammer mode and the hammer drill mode are switched by a rotational operation of the mode-switching dial 60. In other words, a power transmission path in which only an impact force is transmitted to the drill bit and a power transmission path in which an impact force and a rotational force are transmitted to the drill bit are selectively formed by the rotational operation of the mode-switching dial 60. The power transmission path will be described in detail later.

Figure 2:
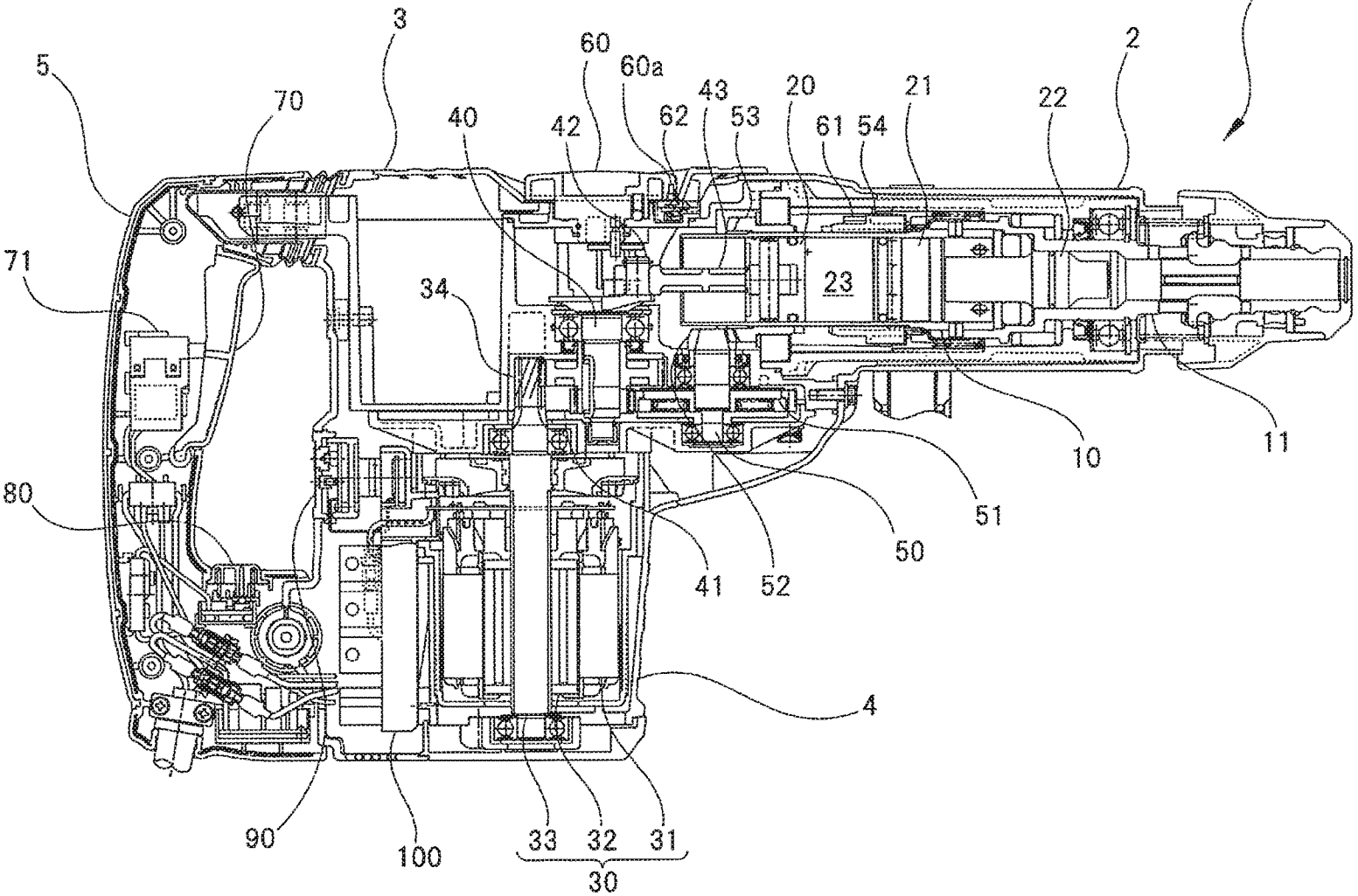
FIG. 2 is another cross-sectional view showing the structure of the hammer drill.

When the mode-switching dial 60 shown in FIG. 1 is rotated by 180 degrees in a first direction, an operation arm 61 moves forward in the axial direction of the cylinder 10 as shown in FIG. 2. Then, the operation arm 61 moving forward pushes the sleeve 54, and the sleeve 54 slides forward against the force of the spring. As a result, engagement of the ring gear 53 and the sleeve 54 is released. When the ring gear 53 and the sleeve 54 are thus disengaged, transmission of the rotational force to the cylinder 10 is cut off.

On the other hand, when the mode-switching dial 60 shown in FIG. 2 is rotated by 180 degrees in a second direction, the operation arm 61 moves backward as shown in FIG. 1. Then, contact of the operation arm 61 and the sleeve 54 is released, and the sleeve 54 slides backward by the force of the spring. As a result, the ring gear 53 and the sleeve 54 are engaged with each other. When the ring gear 53 and the sleeve 54 are thus engaged, the rotational force is transmitted to the cylinder 10.

As shown in FIGS. 1 and 2, the handle 5 has a trigger lever 70 as a first operation part that is operated by an operator, and an ON-lock button 80 as a second operation part that is operated by the operator. In addition, a main switch 71 that is turned on/off based on the operation of the trigger lever 70 is provided inside the handle 5. The ON-lock button 80 contains a lighting part (LED in this embodiment) that is lighted and extinguished in accordance with a predetermined condition. Further, an operation panel 90 including a rotation-number setting button and a plurality of LEDs is also provided in the handle 5. When the rotation-number setting button on the operation panel 90 is pressed, a target rotation number of the brushless motor 30 is switched stepwise in accordance with the number of presses. In addition, the number of lighted LEDs is changed in accordance with the set target rotation, number so as to notify the set target rotation number.

Next, the power transmission path in the hammer drill 1 will be described. When the brushiess motor 30 shown in FIGS. 1 and 2 is actuated, rotation of the output shaft 33 is transmitted to the first driving shaft 40 via the pinion gear 34 and the first gear 41, and the first driving shaft 40 is rotated. In addition, the rotation of the output shaft 33 is transmitted to the second driving shaft 50 via the pinion near 34, the first gear 41, and the second gear 51, and the second driving shaft 50 is rotated.

When the first driving shaft 40 rotates, the eccentric pin 42 provided at the upper end of the first driving shaft 40 is rotated about a center axis of the first driving shaft 40 as a rotation axis. Namely, the eccentric pin 42 revolves around the center axis of the first driving shaft 40. Consequently, the piston 20 coupled to the eccentric pin 42 via the connecting rod 43 is reciprocally moved in the cylinder 10. When the piston 20 moves in a direction separating from the impact element 21, namely, when, the piston 20 moves backward, pressure in the air chamber 23 is decreased, and the impact element 21 moves backward. On the other hand, when, the piston 20 moves in a direction approaching to the impact element 21, namely, when the piston 20 moves forward, the pressure in the air chamber 23 is increased, and the impact element 21 moves forward. When the impact element 21 moves forward, the impact element 21 impacts the intermediate element 22, and the intermediate element impacts the drill bit (not shown). The impact force is intermittently transmitted to the drill bit in this manner.

When the second driving shaft 50 rotates, the bevel gear 52 provided at an upper end of the second driving shaft 50 is rotated, and the ring gear 53 meshed with the bevel gear 52 is rotated. At this time, when the hammer mode is selected by the rotational operation of the mode-switching dial 60, namely, when engagement of the ring gear 53 and the sleeve 54 is released as shown in. FIG. 2, rotation of the ring gear 53 is not transmitted to the cylinder 10, and the ring gear 53 is idly rotated on the cylinder 10. Consequently, the rotational force is not transmitted to the drill bit, and only the impact force is transmitted thereto.

On the other hand, when the hammer drill mode is selected by the rotational operation of the mode-switching dial 60, namely, when the ring gear 53 and the sleeve 54 are engaged as shown in FIG. 1, the rotation of the ring gear 53 is transmitted to the cylinder 10 via the sleeve 54, and the cylinder 10 and the retainer sleeve 11 are integrally rotated. Accordingly, the impact force is intermittently transmitted to the drill bit held by the retainer sleeve 11, and the rotational force is continuously transmitted thereto.

Figure 3:
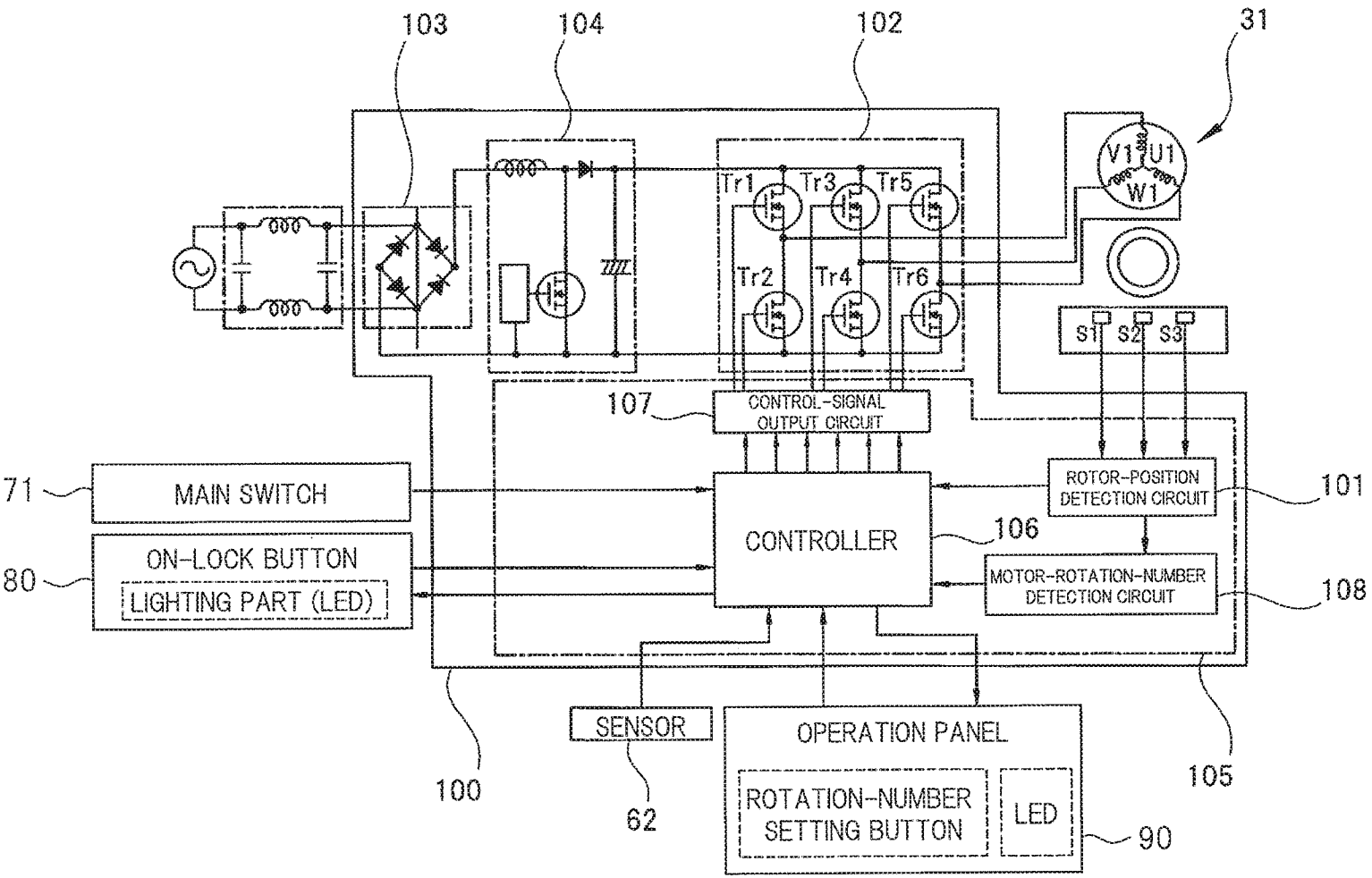
FIG. 3 is a block diagram showing various circuits provided in the hammer drill.

Next, various circuits provided in the hammer drill according to the present embodiment and a circuit configuration or the like of the brushless motor 30 will be described with reference to FIG. 3. As shown in FIGS. 1 and 2, a control board is provided between the brushiess motor 30 and the handle 5. As shown in FIG. 3, the brushless motor 30, the main switch 71, the ON-lock button 80, the operation panel 90 and the like described above are electrically connected to the control board 100. In addition, a switching circuit 102, a rectifier circuit 103, a power factor improvement circuit 104, and a motor control unit 105 including a controller 106 and the like described later are mounted on the control board 100.

As shown in FIG. 3, the stator 31 of the brushless motor 30 (FIGS. 1 and 2) includes coils U1, V1, and W1 corresponding to U-phase, V-phase, and W-phase. On the other hand, four permanent magnets of two types with different polarities are provided in the rotor 32 (FIGS. 1 and 2) of the brushless motor 30. These four permanent magnets are disposed along a rotational direction of the rotor 32 at equal intervals. As shown in FIG. 3, three magnetic sensors S1, S2, and S3 are disposed near the rotor 32. These magnetic sensors S1, S2, and S3 detect variation in magnetic force attendant on the rotation of the rotor 32, and output an electric signal to a rotor-position detection circuit 101. Hall elements are used for the magnetic sensors S1, S2, and S3 in this embodiment.

The switching circuit 102 shown in FIG. 3 controls power supply to the coils U1, V1, and W1 of the stator 31. The rectifier circuit 103 that converts AC current to DC current and the power factor improvement circuit 104 that boosts a voltage of the DC current output from the rectifier circuit 103 and supplies it to the switching circuit 102 are disposed before the switching circuit 102. The rectifier circuit 103 is a bridge circuit in which four diode elements are connected with each other. The power factor improvement circuit 104 has a field effect transistor, an integrated circuit that outputs a pulse width modulation (PWM) control signal to the field effect transistor, and a capacitor, and suppresses a high frequency current generated in the switching circuit 102 to a limit value or less.

The switching circuit 102 is a 3-phase full-bridge inverter circuit, and has two switching elements Tr1 and Tr2 connected in parallel, two switching elements Tr3 and Tr4 connected in parallel, and two switching elements Tr5 and Tr6 connected in parallel. Each of the switching elements is an IGBT (Insulated Gate Bipolar Transistor). The switching elements Tr1 and Tr2 are connected to the coil U1 to control current supplied to the coil U1. The switching elements Tr3 and Tr4 are connected to the coil V1 to control current supplied to the coil V1. The switching elements Tr5 and Tr6 are connected to the coil W1 to control current supplied to the coil W1.

The switching elements Tr1, Tr3, and Tr5 are connected to positive-electrode-side output terminal of the power factor improvement circuit 104, and the switching elements Tr2, Tr4, and Tr6 are connected to a negative-electrode-side output terminal of the power factor improvement circuit 104. Namely, the switching elements Tr1, Tr3, and Try are on a high side, and the switching elements Tr2, Tr4, and Tr6 are on a low side.

In this embodiment, the coils U1, V1, and W1 are star-connected. However, a connection method of the coils U1, V1, and W1 is riot limited to the star connection, and it may be, for example, a delta connection.

The motor control unit 105 shown in FIG. 3 includes the controller 106 as a control part, a control-signal output circuit 107, the rotor-position detection circuit 101, and a motor-rotation-number detection circuit 108. The controller 106 computes and outputs a signal for controlling the brushless motor 30. The control signal output from the controller 106 is input to the switching circuit 102 through the control signal output circuit 107. The rotor-position detection circuit 101 detects a rotational position of the rotor 32 (FIGS. 1 and 2) based on the electric signal output from the magnetic sensors S1, S2, and S3, and outputs a signal indicating the rotational position of the rotor 32. The position detection signal output from the rotor-position detection circuit 101 is input to the controller 106 and the motor-rotation-number detection circuit 108. The motor-rotation-number detection circuit 108 detects the rotation number of the rotor, namely, the motor rotation number, and outputs a signal indicating the motor rotation number. The rotation-number detection signal output from the motor-rotation-number detection circuit 108 is input to the controller 106. The controller 106 performs feedback control based on the rotation-number detection signal so that the motor rotation number is maintained, at the target rotation number.

An ON signal and an OFF signal which are output from the main switch 71 by the operation of the trigger lever 70 shown in FIGS. 1 and 2 are input to the controller 106 shown in FIG. 3. When the trigger lever 70 shown in FIGS. 1 and 2 is operated by an operator, the main switch 71 outputs the ON signal or the OFF signal in accordance with the operation. To be specific, the ON signal is output from the main switch 71 when the trigger lever 70 is pulled, and the OFF signal is output from the main switch 71 or the output of the ON signal is stopped when the pulling of the trigger lever 70 is released. When the controller 106 receives the ON signal output from the main switch 71, it determines that the main switch 71 is turned on. On the other hand, when the controller 106 receives the OFF signal output from the main switch 71 or when the reception of the ON signal ceases, the controller 106 determines that the main switch 71 is turned off.

An ON-lock signal output from the ON-lock button 80 shown in FIGS. 1 and 2 is input to the controller 106 shown in FIG. 3. The ON-lock button 80 in this embodiment is a tactile switch that outputs (transmits) a signal for each operation. Accordingly, the ON-lock signal is input to the controller 106 shown in FIG. 3 every time when the ON-lock button 80 is operated. In other words, the controller 106 receives the ON-lock signal every time when the ON-lock button 80 is pressed.

Referring back to FIGS. 1 and 2, a sensor 62 as a mode detection part is provided in the intermediate housing 3. This sensor 62 outputs (transmits) an electric signal (mode detection signal) when the mode-switching dial 60 is rotationally operated to a predetermined position. The mode detection signal output from the sensor 62 is input to the controller 106 shown in FIG. 3. The mode-switching dial 60 shown in FIGS. 1 and 2 contains a permanent magnet 60*a*. When the mode-switching dial 60 is rotationally operated to a position shown in FIG. 2, namely, when the hammer mode is selected, the permanent magnet 60*a* contained in the mode-switching dial 60 is positioned near the sensor 62 (right above the sensor 62 in this embodiment). Then, the sensor 62 detects a magnetic force of the permanent magnet 60*a*, and the sensor 62 outputs the mode detection signal. On the other hand, when the mode-switching dial 60 is rotationally operated to a position shown in FIG. 1, namely, when the hammer drill mode is selected, the permanent magnet 60*a* contained in the mode-switching dial 60 is separated from the sensor 62. Then, the sensor 62 does not detect the magnetic force of the permanent magnet 60*a*, and the output of the mode detection signal from the sensor 62 ceases. Consequently, the controller 106 shown in FIG. 3 can determine whether the selected operating mode is the hammer mode or not depending on presence or absence of the input of the mode detection signal.

Figure 4:
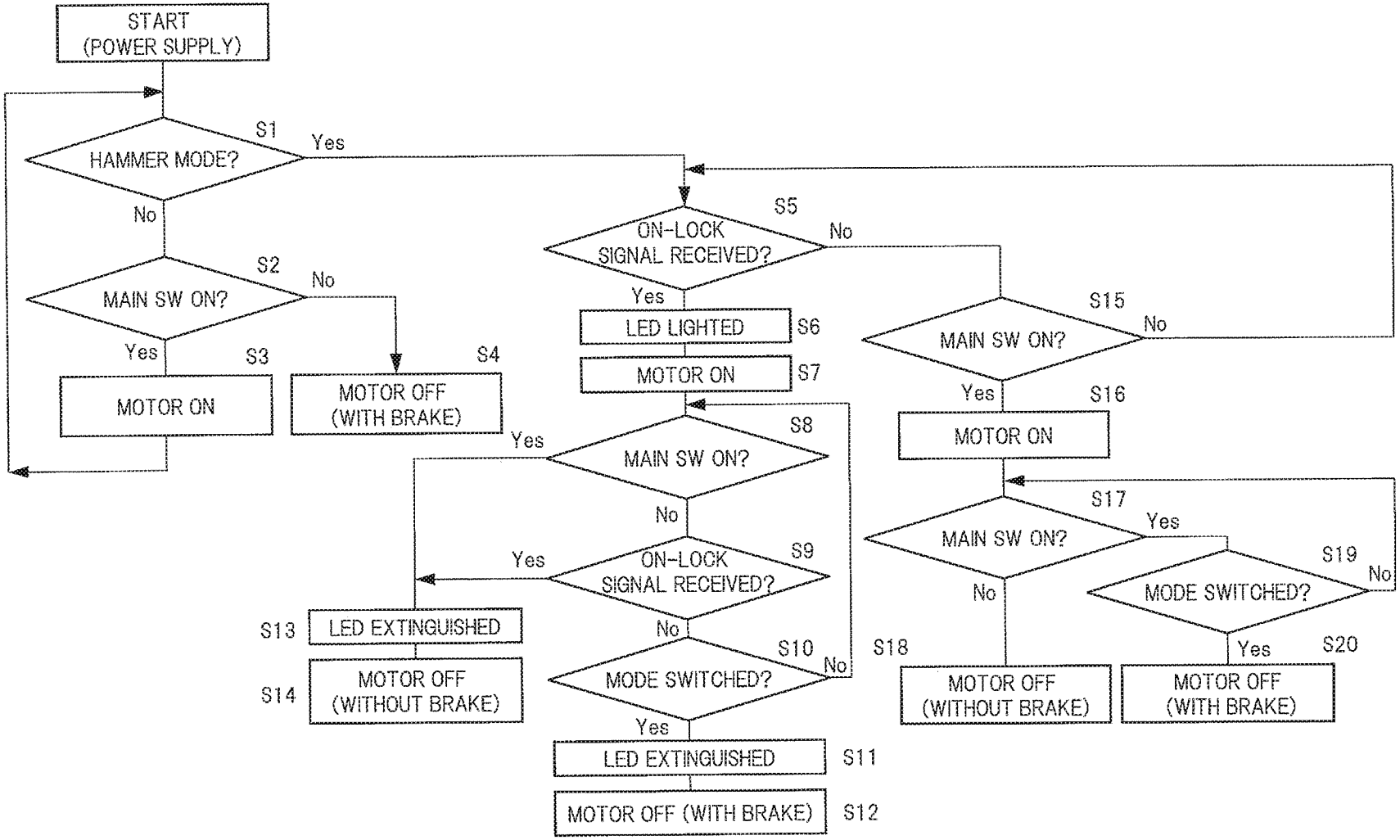
FIG. 4 is a flowchart showing one example of ON/OFF control of a brushless motor.

(First Control Flow) Next, one example of control of the brushless motor 30 (ON/OFF control) which is performed by the controller 106 shown in FIG. 3 will be described mainly with reference to FIGS. 3 and 4. Note that the brushiess motor 30 is abbreviated to a "motor 30" in the following description.

When a power cable is connected to a power source, control by the controller 106 is started. The controller 106 firstly determines whether the selected operating mode is the hammer mode or not (S1). When the operating mode is not the hammer mode (S1: No), the controller 106 determines whether the main switch 71 is turned on or not (S2). Namely, the controller 106 determines whether the trigger lever 70 (FIGS. 1 and 2) is pulled or riot. When the main switch 71 is turned on (S2: Yes), the controller 106 turns on the motor 30 (S3). Thereafter, the controller 106 repeats the steps S1 to S3 to maintain the operating state of the motor 30. However, if the main switch is turned off during the repetition of the steps S1 to S3 (S2: No), the controller 106 performs an active-stop control. To be specific, the controller 106 turns off the motor 30, and also applies a brake to the motor 30 (S4). More specifically, the controller 106 selectively turns on/off the switching elements Tr1, Tr2, Tr3, Tr4, T5, and Tr6 to forma closed circuit including at least one of the coils V1, U1, and W1 provided in the stator 31. Consequently, when the rotor 32 (FIGS. 1 and 2) rotates, a regenerative brake acts on the rotor 32. Thus, the active-stop control includes a braking process for actively stopping the rotation of the motor 30 (rotor 32).

As described above, when the selected operating mode is the hammer drill mode, the motor 30 is started up by the operation of the trigger lever 70 shown in FIGS. 1 and 2. In addition, ON/OFF of the motor 30 is controlled based on the operation of the trigger lever 70. Further, when the operation of the trigger lever 70 is released, the motor 30 is topped by the active-stop control including the braking process. Accordingly, it is possible to prevent the motor 30 from continuously rotating by inertia, or suppress the time of the rotation by inertia to an extremely short time, after the operation of the trigger lever 70 is released.

On the other hand, when the selected operating mode is the hammer mode (S1: Yes), the controller 106 determines the presence or absence of the reception of the ON-lock signal (S5). Namely, the controller 106 determines whether the ON-lock button 80 (FIGS. 1 and 2) is pressed or not. When the controller 105 receives the ON-lock signal (S5: Yes), the controller 106 lights the LED contained in the ON-lock button 80 (S6) and turns on the motor 30 (S7).

Next, the controller 106 determines whether the main switch 71 is turned on or not (S8). Namely, the controller 106 determines whether the trigger lever 70 (FIGS. 1 and 2) is pulled or not. When the main switch 71 is not turned on (S8: No), the controller 106 determines the presence or absence of the reception of the ON-lock signal (S9). When the controller 106 does not receive the ON-lock signal (S9:

No), the controller 106 determines the presence or absence of the reception of the mode detection signal (810). Namely, the controller 106 determines the presence or absence of the operation of the mode-switching dial 60 (FIGS. 1 and 2) When it is determined that the mode detection signal is received and the mode is not switched (S10: No), the controller 106 returns to the step S8. Thereafter, the controller 106 repeats the steps S8 to S10 to maintain the motor 30 in the operating state. In other words, the controller 106 performs the ON-lock control to maintain the motor 30 in the operating state even when the trigger lever 70 (FIGS. 1 and 2) is not operated.

However, when it is determined that the mode detection signal is not received and the mode is switched (S10: Yes) while the ON-lock control is performed (during the repetition of the steps S8 to S10), the controller 106 extinguishes the LED contained in the ON-lock button 80 (S11), and performs the active-stop control (S12). Namely, when the operating mode is switched while the ON-lock control is performed, the motor 30 is stopped by the active-stop control including the braking process.

Moreover, when the main switch 71 is turned on (S8: Yes) or the ON-lock signal is received (S9: Yes) while the ON-lock control is performed (during the repetition of the steps S8 to S10), the controller 106 extinguishes the LED contained in the ON-lock button 80 (S13), and performs a natural-stop control. To be specific, the controller 106 turns off the motor 30 (S14). More specifically, the controller 106 turns off the switching elements Tr1, Tr2, Tr3, Tr4, Tr5, and Tr6, and cuts off the power supply to the coils V1, U1 and W1 provided in the stator 31. Namely, when the trigger lever 70 (FIGS. 1 and 2) is pulled or the ON-lock button 80 (FIGS. 1 and 2) is pressed while the ON-lock control is performed, the motor 30 is stopped by the natural-stop control including no braking process. Note that, when the operating mode is switched while the ON-lock control is performed, the motor 30 is stopped by the active-stop control including the braking process as described above. Namely, the stop control performed by the controller 106 includes at least two stop controls (active-stop control and natural-stop control) with different braking forces to the motor 30, and the controller 106 performs either of these two stop controls in accordance with a predetermined condition.

As described above, when the hammer mode is selected, the motor 30 can be started up and the ON-lock control can be performed by one operation of the ON-lock button 80. In other words, the ON-lock control can be performed only when the hammer mode is selected. In addition, lighting of the LED contained in the ON-lock button 80 (FIGS. 1 and 2) notifies that the ON-lock control is performed. Moreover, when the operating mode is switched while the ON-lock control is performed, the active-stop control including the braking process is performed. This avoids the occurrence of reaction due to sudden transmission of a rotational force. On the other hand, when the trigger lever 70 or the ON-lock button 80 (FIGS. 1 and 2) is operated while the ON-lock control is performed, the natural-stop control including no braking process is performed. In other words, the operation of the trigger lever 70 or the ON-lock button 80 can stop the ON-lock control, and thus stop the motor 30. Consequently, even when the trigger lever 70 and the ON-lock button 80 are operated again immediately after releasing the operation thereof, rotation number of the motor 30 smoothly rises.

When the ON-lock signal is not received in the step S5 (S5: No), the controller 106 determines whether the main switch 71 is turned on or not (S15). Namely, the controller 106 determines whether the trigger lever 70 (FIGS. 1 and 2) is pulled or not. When the main switch 71 is turned on (S15: Yes), the controller 106 turns on the motor 30 (S16). After turning on the motor 30, the controller 106 determines whether the main switch 71 is turned on or not (S17), and when the main switch 71 is not turned on (S17: No), the controller 106 stops the motor 30 by the natural stop control (S18). On the other hand, when the main switch 71 is turned on (S17: Yes), the controller 106 determines the presence or absence of the reception of the mode detection signal (S19). Namely, the controller 106 determines the presence or absence of the operation of the mode-switching dial 60 (FIGS. 1 and 2). When it is determined that the mode detection signal is received and the mode is not switched (S19: No), the controller 106 returns to the step S17. Thereafter, the controller 106 repeats the steps S17 and S19 to maintain the motor 30 in the operating state. However, when it is determined that the mode detection signal is not received and the mode is switched (S19: Yes) during the repetition of the steps S17 and S19, the controller 106 stops the motor 30 by the active-stop control (S20).

As described above, when the hammer mode is selected, the motor 30 can be started up also by the operation of the trigger lever 70 shown in FIGS. 1 and 2, and the motor 30 can be turned on/off based on the operation of the trigger lever 70. At this time, the natural-stop control including no braking process is performed when the operation of the trigger lever 70 is released during the rotation of the motor 30, and the active-stop control including the braking process is performed when the operating mode is switched. In the former case, even when the trigger lever 70 is operated again immediately after releasing the operation of the trigger lever 70, the rotation number of the motor 30 smoothly rises. In the latter case, it is possible to avoid the occurrence of reaction due to sudden transmission of a rotational force caused by the mode switching.

Figure 5:
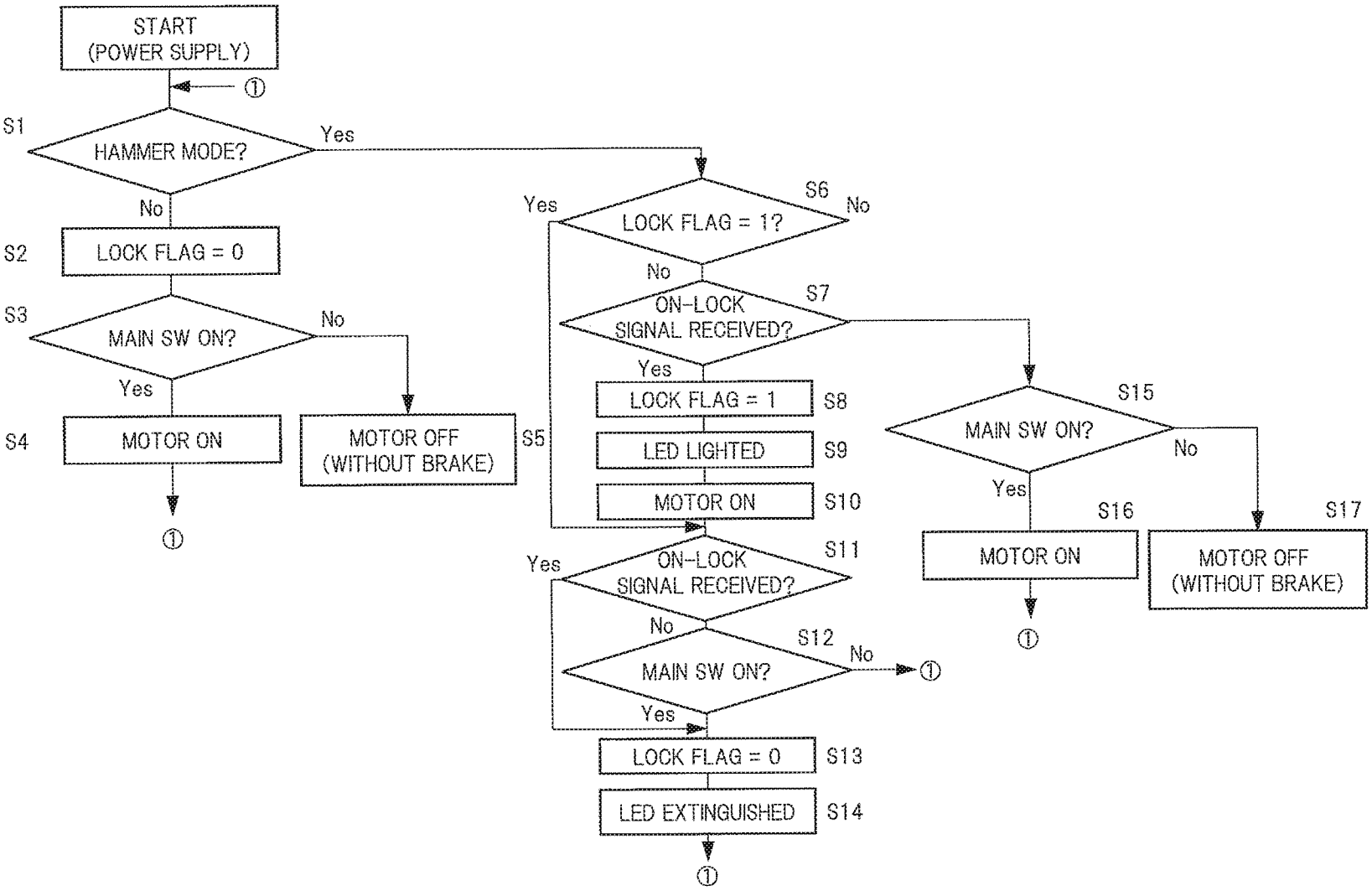
FIG. 5 is a flowchart showing another example of the ON/OFF control of the brushless motor.

(Second Control Flow) Next, another example of control of the brushless motor 30 (ON OFF control) which is performed by the controller 106 shown in FIG. 3 will be described mainly with reference to FIGS. 3 and 5.

When a power cable is connected to a power source, control by the controller 106 is started. The controller 106 firstly determines whether the selected operating mode is the hammer mode or not (S1). When the operating mode is not the hammer mode (S1: No), the controller 106 sets a lock flag to "0" (S2), and determines whether the main switch 71 is turned on or not (S3). Namely, the controller 106 determines whether the trigger lever 70 (FIGS. 1 and 2) is pulled or not. When the main switch 71 is turned on (S3: Yes), the controller 106 turns on the motor 30 (S4). Namely, the controller 106 starts up the motor 30. Thereafter, the controller 105 repeats the steps S1 to S4 to maintain the motor 30 in the operating state. However, if the main switch 71 is turned off during the repetition of the steps S1 to S4 (S3: No), the controller 106 performs the natural-stop control and turns off the motor 30 (S5). Namely, if the pulling of the trigger lever 70 is released during the repetition of the steps S1 to S4, the natural-stop control is performed.

As described above, when the selected operating mode is the hammer drill mode, the motor 30 is started up by the operation of the trigger lever 70 shown in FIGS. 1 and 2. In addition, ON/OFF of the motor 30 is controlled based on the operation of the trigger lever 70. Further, when the operation of the trigger lever 70 is released, the motor 30 is stopped by the natural-stop control including no braking process.

On the other hand, when the selected operating mode is the hammer mode (S1: Yes), the controller 106 determines whether the lock flag is "1" or not (S6). When the lock flag is not "1" (S6: No), the controller 106 determines the presence or absence of the reception of the ON-lock signal (S7). Namely, the controller 106 determines whether the ON-lock button 80 (FIGS. 1 and 2) is pressed or not. When the controller 106 receives the ON-lock signal (S7: Yes), the controller 106 changes the lock flag to "1" (S8), lights the LED contained in the ON-lock button 80 (S9), and turns on the motor 30 (S10). Then, the controller 106 shifts is to step S11. Note that, when the lock flag is "1" in the step S6 (S6: Yes), the controller 106 skips the steps S7 to S10 and shifts to the step S11.

In the step S11, the controller 106 determines the presence or absence of the reception of the ON-lock signal (S11). When the controller 106 does not receive the ON-lock signal (S11: No), the controller 106 determines whether the main switch 71 is turned on or not (S12). When the main switch 71 is not turned on (S12: No), the controller 106 returns to the step S1. Thereafter, the controller 106 repeats the steps S1, S6, S11 and S12 to maintain the motor 30 in the operating state. In other words, the controller 106 performs the ON-lock control to maintain the motor 30 in the operating state even when the trigger lever 70 (FIGS. 1 and 2) is not operated.

As described above, when the hammer mode is selected, the motor 30 can be started up and the ON-lock control can be performed by one operation of the ON-lock button 80. In other words, the ON-lock control can be performed only when the hammer mode is selected. In addition, lighting of the LED contained in the ON-lock button 80 (FIGS. 1 and 2) notifies that the ON-lock control is performed.

However, when the ON-lock signal is received (S11: Yes) or the main switch 71 is turned on (S12: Yes) while the ON-lock control is performed (during the repetition of the steps S1, S6, S11, and S12), the controller 106 shifts to step S13. Namely, if the trigger lever 70 (FIGS. 1 and 2) is pulled or the ON-lock button 80 (FIGS. 1 and 2) is pressed while the ON-lock control is performed, the controller 106 shifts to the step S13.

After shifting to the step S13, the controller 106 changes the lock flag to "0" (S13), and extinguishes the LED contained in the ON-lock button. 80 (S14).

Then, the controller 106 shifts to step S15 through the steps S1, S6, and S7. In the step S15, the controller 106 determines whether the main switch 71 is turned on or not (S15). Namely, the controller 106 determines whether the trigger lever 70 (FIGS. 1 and 2) is pulled or not. When the main switch 71 is turned on (S15: Yes), the controller 106 maintains the operating state of the motor 30 (S16). Thereafter, the controller 106 repeats the steps S1, S6, S7, S15, and S16 to continuously maintain the operating state of the motor 30. However, if the main switch 71 is turned off during the repetition of the steps S1, S6, S7, S15, and S16 (S15: No), the controller 106 performs the natural-stop control and turns off the motor 30 (S17). Namely, if the pulling of the trigger lever 70 (FIGS. 1 and 2) is released during the repetition of the steps S1, S6, S7, S15, and S16, the natural-stop control is performed.

As described above, if the trigger lever 70 is operated and the main switch 71 is turned on while the ON-lock control is performed (S12: Yes), the operating state of the motor 30 is maintained until the operation of the trigger lever 70 is released and the main switch 71 is turned off.

Further, if the ON-lock button 80 is operated again and the ON-lock signal is received while the ON-lock control is performed (S11: Yes), the controller 106 shifts to the step S15 through the steps S1, S6, and S7, and further shifts to step S17 to perform the natural-stop control of the motor 30. Namely, if the ON-lock button 80 is operated again while the ON-lock control is performed, the natural-stop control of the motor 30 is performed. Note that, in order to prevent erroneous determination in the steps S7 and S11, the controller 106 determines only the rise of the signal when the ON-lock button 80 is operated, as the reception.

The present invention is not limited to the above-described embodiment, and various modifications and alterations can be made within the scope of the present invention. For example, the present invention is applicable also to an impact tool in which a rotational movement of a motor is converted into a reciprocating motion of a piston through a reciprocating-type conversion mechanism. In addition, the first operating mode in the present invention includes an operating mode in which only an impact force is transmitted to a tool bit, and the second operating mode includes an operating mode in which a rotational force is transmitted to the tool bit. Although the hammer drill according to the above-described embodiment is the impact tool having operating modes such as the hammer mode and the hammer drill mode, the impact tool of the present invention includes an impact tool having operating modes such as a hammer mode and a drill mode and an impact tool having three operating modes such as a hammer mode, a drill mode, and a hammer drill mode.

Note that the natural-stop control including no braking process actively stops the rotation of the motor is one example of the stop control with a smaller braking force than that of the active-stop control. In other words, the natural-stop control and the active-stop control are one example of two stop controls with different braking forces.

The present invention includes an embodiment in which an active-stop control having a relatively small braking force and an active-stop control having a relatively large braking force are selectively performed in accordance with a predetermined condition, and further includes an embodiment in which a controller controls ON/OFF of switching elements to control the number of closed circuits of coils and the formation time of the closed circuit, thereby changing a braking force in accordance with an operating mode. Furthermore, the present invention includes not only an embodiment in which the braking force in the active-stop control is constant, but also an embodiment in which the braking force varies.

REFERENCE SIGNS LIST

1 hammer drill
2 cylinder housing
3 intermediate housing
4 motor housing
5 handle
10 cylinder
20 piston
30 brushless motor (motor)
60 mode-switching dial
62 sensor
70 trigger lever
71 main switch
80 ON-lock button

The invention claimed is:

1. An impact tool having at least two operating modes including a first operating mode in which an impact force is transmitted to a tool bit whereas a rotational force is not transmitted to the tool bit, the impact tool comprising:

a motor as a power source;

a first operation part and a second operation part operated by an operator;

a mode detection part detecting whether a selected operating mode is the first operating mode or not; and a control circuit controlling power supplied to the motor, wherein, the control circuit causes the motor to be in an operating state when the first operation part is changed from a non-pulled position to a pulled position and the control circuit maintains the motor in the operating state while the first operation part is in the pulled position, and after that the control circuit causes the motor to be in a non-operating state when the first operation part is changed from the pulled position to the non-pulled position, wherein the control circuit performs ON-lock control, in response to operation of the second operation part, to maintain the motor in the operating state, and wherein, when the first operation part is changed from the non-pulled position to the pulled position while the control circuit performs the ON-lock control, the control circuit stops performing the ON-lock control to cause the motor to be in the non-operating state and even when the first operation part is maintained in the pulled position, the control circuit continues to maintain the motor in the non-operating state.

2. The impact tool according to claim 1, wherein the second operation part is a tactile switch outputting a signal to the control circuit for each operation.

3. The impact tool according to claim 1, further comprising a lighting part, wherein the control circuit lights the lighting part while the ON-lock control is performed.

4. The impact tool according to claim 1 having a plurality of operating modes including a first operating mode in which the control circuit can perform the ON-lock control when the second operation part is operated and a second operating mode in which the control circuit does not perform the ON-lock control even when the second operation part is operated.

5. The impact tool according to claim 1 having a plurality of operating modes in which operations of a tool bit are different from each other, the impact tool comprising a switching part switching the operating modes, wherein the control circuit stops the operation of the motor when the switching part is operated while the ON-lock control is performed.

6. The impact tool according to claim 1, wherein the control circuit can perform a plurality of stop controls including an active-stop control in which a braking force to the motor is large and a natural-stop control in which the braking force to the motor is small, and the control circuit performs either of these two stop controls in accordance with a predetermined condition.

7. An electric tool comprising:

a motor as a power source;

a first operation part and a second operation part operated by an operator; and a control circuit controlling power supplied to the motor, wherein, the control circuit causes the motor to be in an operating state when the first operation part is changed from a non-pulled position to a pulled position and the control circuit maintains the motor in the operating state while the first operation part is in the pulled position, and after that the control circuit causes the motor to be in a non-operating state when the first operation part is changed from the pulled position to the non-pulled position, wherein the control circuit performs ON-lock control, in response to operation of the second operation part, to maintain the motor in the operating state, and wherein, when the first operation part is changed from the non-pulled position to the pulled position while the control circuit performs the ON-lock control, the control circuit stops performing the ON-lock control and causes the motor to be in the non-operating state, and even when the first operation part is maintained in the pulled position, the control circuit continues to maintain the motor in the non-operating state.

8. The electric tool according to claim 7, wherein the second operation part is a tactile switch outputting a signal to the control circuit for each operation.

9. The electric tool according to claim 7, further comprising a lighting part, wherein the control circuit lights the lighting part while the ON-lock control is performed.

10. The electric tool according to claim 7 having a plurality of operating modes including a first operating mode in which the control circuit can perform the ON-lock control when the second operation part is operated and a second operating mode in which the control circuit does not perform the ON-lock control even when the second operation part is operated.

11. The electric tool according to claim 7 having a plurality of operating modes in which operations of a tool bit are different from each other, the electric tool comprising a switching part switching the operating modes, wherein the control circuit stops the operation of the motor when the switching part is operated while the ON-lock control is performed.

12. The electric tool according to claim 7, wherein the control circuit can perform a plurality of stop controls including an active-stop control in which a braking force to the motor is large and a natural-stop control in which the braking force to the motor is small, and the control circuit performs either of these two stop controls in accordance with a predetermined condition.

* * * * *